United States Patent [19]

Walbridge

[11] 3,987,358

[45] Oct. 19, 1976

[54] CONDITION DETECTOR CIRCUIT

[75] Inventor: Lyman H. Walbridge, Ashland, Mass.

[73] Assignee: The Walter Kidde & Company, Inc., Clifton, N.J.

[22] Filed: Jan. 3, 1975

[21] Appl. No.: 538,254

Related U.S. Application Data

[62] Division of Ser. No. 220,788, Jan. 26, 1972, Pat. No. 3,861,854.

[52] U.S. Cl. ..... 323/18; 323/19; 323/22 SC

[51] Int. Cl.[2] ..... F23N 5/02; G05F 1/52

[58] Field of Search ..... 307/252 UA; 323/16, 323/18, 19, 22 SC, 34, 38; 431/78, 80

[56] References Cited

UNITED STATES PATENTS

| | | | |
|---|---|---|---|
| 3,619,097 | 11/1971 | Clay et al. | 431/80 |
| 3,789,383 | 1/1974 | Vasel | 323/39 X |

*Primary Examiner*—A. D. Pellinen
*Attorney, Agent, or Firm*—John E. Toupal

[57] ABSTRACT

A flame monitoring circuit in which a storage capacitor is connected between the "hot" line of an a.c. power supply and a flame electrode disposed so as to be bathed in the flame being monitored. Because of its rectification properties, the flame causes a flow of direct current that charges the storage capacitor providing a flame indicating signal voltage. A control circuit powered by the a.c. source is coupled to the storage capacitor so as to respond to either the presence or absence thereon of a d.c. signal voltage. Electrically coupling the storage capacitor and the control circuit is a sampling circuit for periodically sampling the energy level stored in the storage capaitor. The sampling circuit includes a discharge capacitor coupled to the storage capacitor so as to receive charging current therefrom and a complementary silicon-controlled rectifier is periodically activated to dump the energy from the discharge capacitor into the gate circuit of a silicon-controlled rectifier in the control circuit. The complementary silicon-controlled rectifier is fired at zero-crossings of the a.c. power source immediately preceding those half cycles during which flame rectified current is produced.

10 Claims, 5 Drawing Figures

CONDITION DETECTOR CIRCUIT

CROSS-REFERENCE TO RELATED APPLICATION

This invention is a division of my co-pending U.S. application, Ser. No. 220,788 filed Jan. 26, 1972, now U.S. Pat. No. 3,861,854 and entitled Flame Monitoring System.

BACKGROUND OF THE INVENTION

This invention relates generally to fuel burners and, more particularly, to fuel control systems for fuel burners.

Extensive efforts have been directed toward the improvement of fuel control systems for fuel burners such as gas and oil burners and the like. Increased system safety and reliability have been primary objectives of such efforts. These objectives, however, generally conflict with an obvious desire to limit the cost and physical size of the systems.

Most burner systems employ fuel supply valves that are automatically controlled by some type of flame sensing mechanism that automatically interrupts fuel flow in response to a predetermined loss of flame condition. According to one common technique, the presence of a flame is indicated by a signal current which is rectified by the flame as a result of the well known ionization phenomena. Although flame rectification provides a relatively effective method of sensing flame, prior systems of this type have suffered from certain disadvantages including the requirement for expensive isolation transformers for isolating the flame sensing circuitry from the power lines. Other problems of prior systems are associated with the necessity for isolating the d.c. flame rectification signal from a.c. component present therewith. In many poor flames the detection of directional conduction is marginal because of leakage in both directions and amplification does not fully solve the problem in that is is susceptible to a.c. pickup particularly when the amplifier is connected to the "hot" side of the line.

The above noted problems are avoided to some extent in the system disclosed in U.S. Pat. No. 3,441,356. In that system a single polarity supply is utilized to produce the flame responsive current and the relative conduction from a positive electrode is compared with that from a negative electrode to establish the presence of flame. However, in that type of system an inadvertent short circuit to the flame sensing electrode will produce a d.c. current that cannot be distinguished from a flame supported signal. Other common problems of this as well as other burner control systems are associated with the electronic elements used to monitor the signals produced by the flame rectification current. Typically, an electronic switching element such as a silicon controlled rectifier is gated by the flame signal to produce a desired control signal. False triggering of such conductor devices by transients is relatively common and reduces overall system reliability.

The object of this invention, therefore, is to provide an improved flame responsive control system for fuel burners that is both reliable and of reasonable cost.

SUMMARY OF THE INVENTION

The invention is a flame monitoring circuit in which a storage capacitor is connected between the "hot" line of an a.c. power supply and a flame electrode disposed so as to be bathed in the flame being monitored. Because of its rectification properties, the flame causes a flow of direct current that charges the storage capacitor providing a flame indicating signal voltage. A control circuit powered by the a.c. source is coupled to the storage capacitor so as to respond to either the presence or absence thereon of a d.c. signal voltage. Electrically coupling the storage capacitor and the control circuit is a sampling circuit for periodically sampling the energy level stored in the storage capacitor. The sampling circuit includes a discharge capacitor coupled to the storage capacitor so as to receive charging current therefrom and a complementary silicon controlled rectifier is periodically activated to dump the energy from the discharge capacitor into the gate circuit of a silicon controlled rectifier in the control circuit. The complementary silicon controlled rectifier is fired at zero-crossings of the a.c. power source immediately preceding those half cycles during which flame rectified current is produced. This insures that the signal level at time of discharge is dependent only upon flame rectified current flow and not upon any temporary charge produced by alternating current flow through the high impedance path provided by the flame. Also, the possibility of inadvertent firings of the silicon controlled rectified by stray signals is substantially reduced.

DESCRIPTION OF THE DRAWINGS

These and other objects and features of the invention will become more apparent upon a perusal of the following description taken in conjunction with the accompanying drawings therein.

DESCRIPTION OF THE PREFERRED EMBODIMENTS

Figure 1:
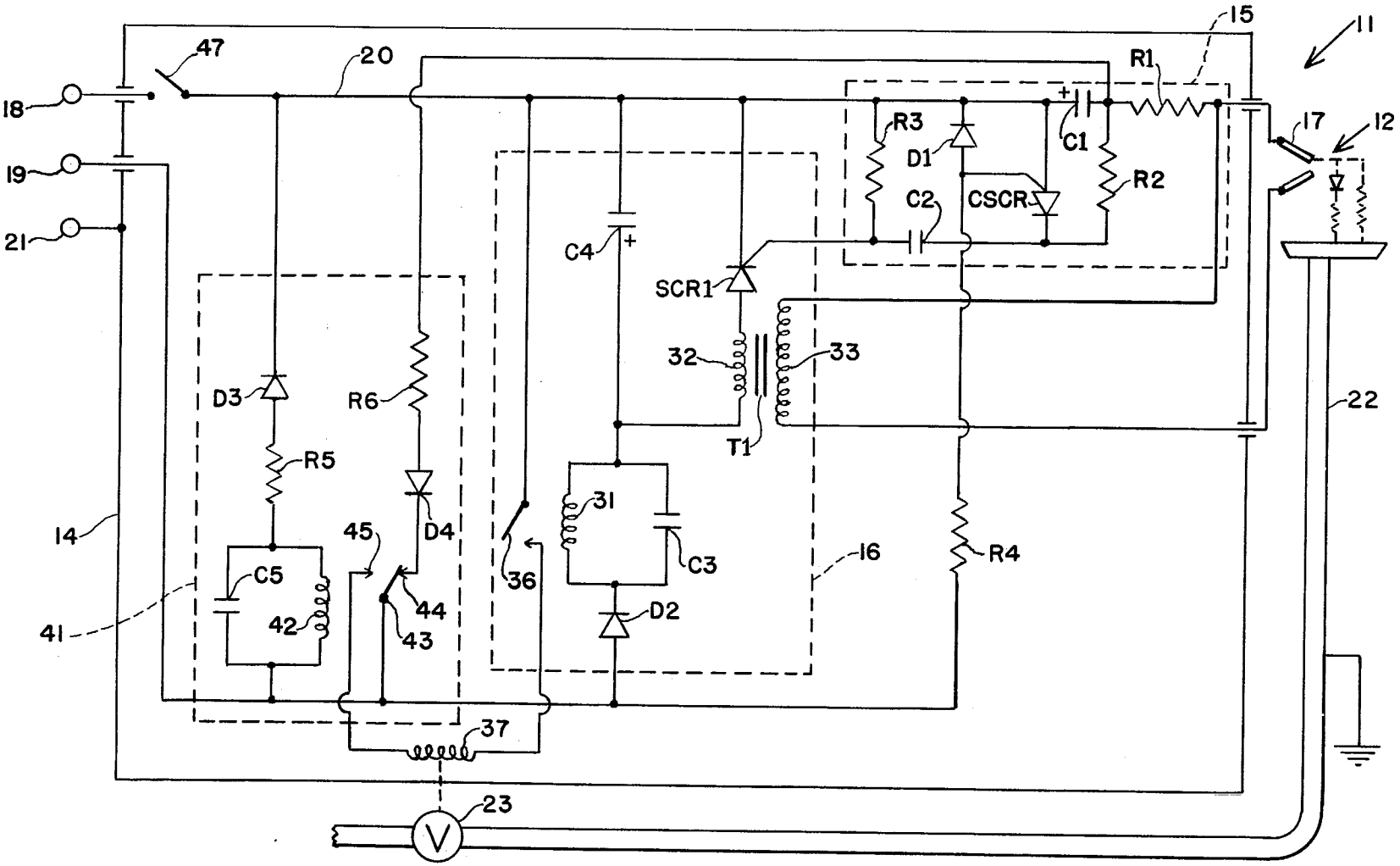
FIG. 1 is a schematic circuit diagram showing a preferred embodiment of the invention.

Referring now to FIG. 1 there is shown a circuit 11 for monitoring the presence or absence of flame in a region 12 directly adjacent a fuel burner 13. The monitoring network 11 is retained by an electrically conductive housing 14 and includes a sensing circuit 15 connected between a control circuit 16 and a flame electrode 17 disposed in the flame region 12. Power is supplied to the network 11 by connection of a first terminal 18 and a second terminal 19 to a conventional a.c. source. The terminal 18 is connected to a line 20 while a third terminal 21 is connected to the conductive housing 14. Fuel such as natural gas or oil, for example, is supplied to the burner 13 through a supply pipe 22 and a solenoid controlled valve 23.

The sensing circuit 15 includes a storage capacitor C1 and resistor R1 connected in series between the terminal 18 and the flame electrode 17. A further element of the sensing circuit 15 is a sampling circuit comprising a complementary silicon controlled rectifier (CSCR) having an anode connected to the line 20 and a cathode connected to a junction between the resistor R2 and the capacitor C2. The gate electrode of the CSCR is connected to the line 20 by a diode D1 and to the terminal 19 by a resistor R4. Also included in the sampling circuit is a series combination of a filter resistor R2, a discharge capacitor C2 and a signal resistor R3 connected across the storage capacitor C1.

Included in the control circuit 16 are a parallel combination of a solenoid relay winding 31 and a filter capacitor C3 connected to the line 20 by a capacitor C4 and to the terminal 19 by a diode D2. Additional elements of the control circuit 16 are an ignition transformer T1 and a silicon controlled rectifier (SCR1). the primary winding 32 of the transformer T1 is connected between the capacitor C4 and the anode of the SCR, the cathode of which is connected to the line 20. Signal coupling between the sensing circuit 15 and the control circuit 16 is provided by a connection between the gate of the SCR1 and the junction between the discharge capacitor C2 and the signal resistor R3. The secondary winding of the transformer T1 is connected between a spark electrode 34 positioned in the flame region 12 and the flame electrode 17 which also serves as a second spark electrode.

A start-up circuit 41 is also included in the network 11 shown in FIG. 1. The start-up circuit 41 includes a parallel combination of a filter capacitor C5 and a relay winding 42 connected in series with a resistor R5 and a diode D3 across the input terminals 18 and 19. Actuated by the winding 42 is a switch with a movable contact 43 connected to the input terminal 19. With the winding 42 de-energized, the movable contact 43 engages a stationary contact 44 connected to the junction between capacitor C1 and resistor R1 by a resistor R6 and a diode D4. Energization of the winding 42 moves the contact 43 into engagement with a stationary contact 45 connected to one end of a solenoid 37 that controls the fuel supply valve 23. The other end of the solenoid 37 is connected to a normally open switch 36 that is activated by the winding 31.

During installation, the network 11 is connected to a conventional 115 volt power source with terminal 18 connected to the "hot" line and terminal 19 connected to the neutral wire. Assuming a typical three wire supply, the terminal 21 is connected to the ground wire assuring that the housing 14 is at the ground potential of the supply pipe 22 and the burner 13.

Figure 2A:
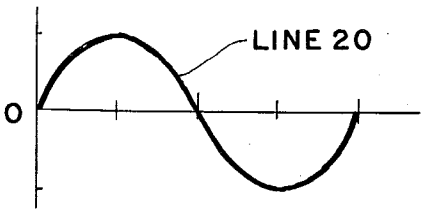
FIGS. 2*a*, 2*b*, 2*c* are graphs showing various waveforms present in the circuit of FIG. 1.
Figure 2B:
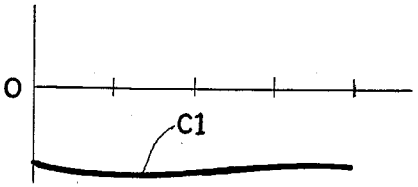

To initiate operation of the burner 13, an on-off switch 47 is closed so as to produce on line 20 the sine wave voltage illustrated in FIG. 2*a*. Because of a time delay provided by the capacitor C5 the winding 42 is not immediately energized and the contacts 43 and 44 remain engaged to provide a current path through the storage capacitor C1, the resistor R6 and the diode D4 during positive half cycles on the line 20. Consequently, there is built up in the storage capacitor C1 a charge having the polarity indicated in FIG. 1. This charge on storage capacitor C1 which is, for example, in the range of about 10 volts is illustrated by the waveform in FIG. 2*b* shown in time alignment with the waveform in FIG. 2*a*. The diode D1 biases the gate of the CSCR negative when the voltage on line 20 is positive causing it to conduct and biases the gate positive by the amount of forward drop in the diode D1 while the voltage on line 20 is negative insuring non-conduction of the CSCR. Thus, as the CSCR becomes conductive during a portion of each positive half cycle on line 20 so as to shunt the capacitor C2 through resistor R3 and the capacitor C1 through resistor R2. However, during negative half cycles on line 20, the CSCR is non-conductive and discharge capacitor C2 is charged through R2 in accordance with the charge remaining on storage capacitor C1. As the voltage on line 20 goes positive to fire the CSCR, any appreciable charge on discharge capacitor C2 appears as a positive pulse across the resistor R3 to fire the SCR 1.

Triggering of the SCR 1 allows the capacitor C4 which on the previous half cycle was charged with the polarity indicated in FIG. 1 to discharge through the primary winding 32 of the transformer T1. This produces a high voltage pulse in the secondary 33 and a resultant spark between the electrodes 17 and 34. During the next negative half cycle on line 20 the capacitor C4 is again charged by current flow through the diode D2 and the relay winding 31. This operation continues producing during each cycle on line 20 an ignition spark in the region 12 between electrodes 17 and 34 and a surge of current through the relay winding 31 maintaining energization thereof and resultant closure of the switch 36. As described above, the winding 42 is not immediately energized because of the time constant exhibited by the capacitor C5. After a certain delay, however, the winding becomes energized moving the contact 42 into engagement with the fixed contact 45. Simultaneously, contacts 43 and 44 are opened to terminate the supply of line current to the storage capacitor C1 which, however, retains sufficient charge to supply charging current to the capacitor C2 which continues firing the SCR1 for a given ignition period in the manner described above. During that period both switch 36 and contacts 44, 45 are closed to energize the valve solenoid 37. In respone to energization to solenoid 37, the valve 23 opens initiating fuel flow to the burner 13.

Assuming that the fuel fed to the burner 13 is ignited, a flame appears in the region 12 occupied by the electrodes 17 and 34. As is well known, that flame acts as an imperfect diode that may be represented (as shown dotted in FIG. 1) by a perfect diode with a high resistance in series and another high resistance in parallel with the combination. The flame produced diode is polarized such that the greater current flow occurs through the flame on the positive half cycles illustrated in FIG. 2*a*. Thus, the maintenance of a charge on the storage capacitor C1 is indicative of current flow supported by flame in the region 12. The presence of charge on the capacitor C1 insures continued operation of the sensing circuit 15 and control circuit 16 in the manner described above to insure continued flow of fuel through the valve 23.

If at any time the flame in region 12 is extinguished, the network 11 tries for reignition during a brief ignition period. As described above, this period is provided by the storage capabilities of the capacitor C1 which continues to supply current to the discharge capacitor C2 for a limited period even in the absence of continuing flame rectified current flow. However, if the flame is not reignited within the short ignition period, the absence of flame rectified current flow will result in discharge of the capacitor C1 and eliminate periodic charging current flow to the discharge capacitor C2. COnsequently, no further pulses will be produced across the resistor R3 to fire the SCR1, which will remain non-conductive terminating periodic discharge of the capacitor C4. This in turn will eliminate energizing current flow through the winding 31 to open the switch 36 and de-energize solenoid 37.

Thus, a prolonged loss of flame in the region 12 automatically results in closing of valve 23 to prevent further fuel flow to the burner 13. Furthermore, because the winding 42 in the startup circuit 41 remains energized to prevent engagement of contacts 43 and 44 and, accordingly, charging current flow through the storage capacitor C1, a new try for ignition can be initiated only by a loss of power between the terminals 18 and 19. That occurrence caused for example by opening the switch 47, will deenergize winding 42 allowing contact to be made between contacts 43 and 44 and producing another try for ignition in the manner described above. It will be appreciated that this reignition in the manner described will be required also in the event that ignition is not initially achieved within the ignition period provided by retained charge in the storage capacitor C1.

It will be noted with regard to the network 11 shown in FIG. 1, that the sensing circuit 15 is current isolated from the control circuit 16. Any current available for charging the storage capacitor C1 and accordingly the discharge capacitor C2 must be supported by flame in the region 12 which completes a path to the ground circuit including the burner 13 and the ground terminal 21. Thus, any energy available in the discharge capacitor C2 for producing a flame signal across the resistor R3 that in turn triggers SCR1 can result only from current flow through a flame in region 12. Furthermore, by utilizing as a flame signal a pulse of stored energy having a level dependent upon the flame condition being sensed, no signal amplification is required. For these reasons highly reliable signal information is provided and, in addition, circuit isolating the neutral terminal 19 from the ground circuit eliminates the need for isolation transformers.

Of further note is the utilization of the flame signal applied to the SCR1 in the control circuit 16 with respect to the hot line 20 thereby substantially reducing the effect on the sensing signal of a.c. present within the system.

Figure 2C:
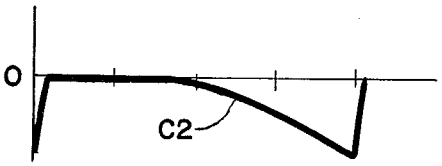

It will be appreciated however, that on an instantaneous basis some a.c. effects are present in the measuring circuit 15. As noted above the flame acts as an imperfect rather than a perfect diode and does support a small component of a.c. This is demonstrated in FIG. 2*b* wherein the negative flame voltage on capacitor C1 increases during the positive half cycle on signal line 20 and then decreases to its steady state value at the conclusion of the negative half cycle on line 20. The present invention reduces this a.c. effect by the above described sampling of the charge energy stored in the discharge capacitor C2 at a particular time during the a.c. cycle. As shown by FIG. 2c the sampling diode D1 triggers the CSCR to discharge the capacitor C2 at each positive going transition of the voltage on line 20. Those are the particular a.c. zero-crossings which initiate a.c. current flow in the same sense as the d.c. flame current through the storage capacitor C1. As illustrated by FIG. 2*b*, it is at those particular times that the opposite half cycle a.c. effect on the capacitor C1 have compensated each other leaving a steady state d.c. signal responsive only to the d.c. current provided by the sensed flame condition.

Figure 3:
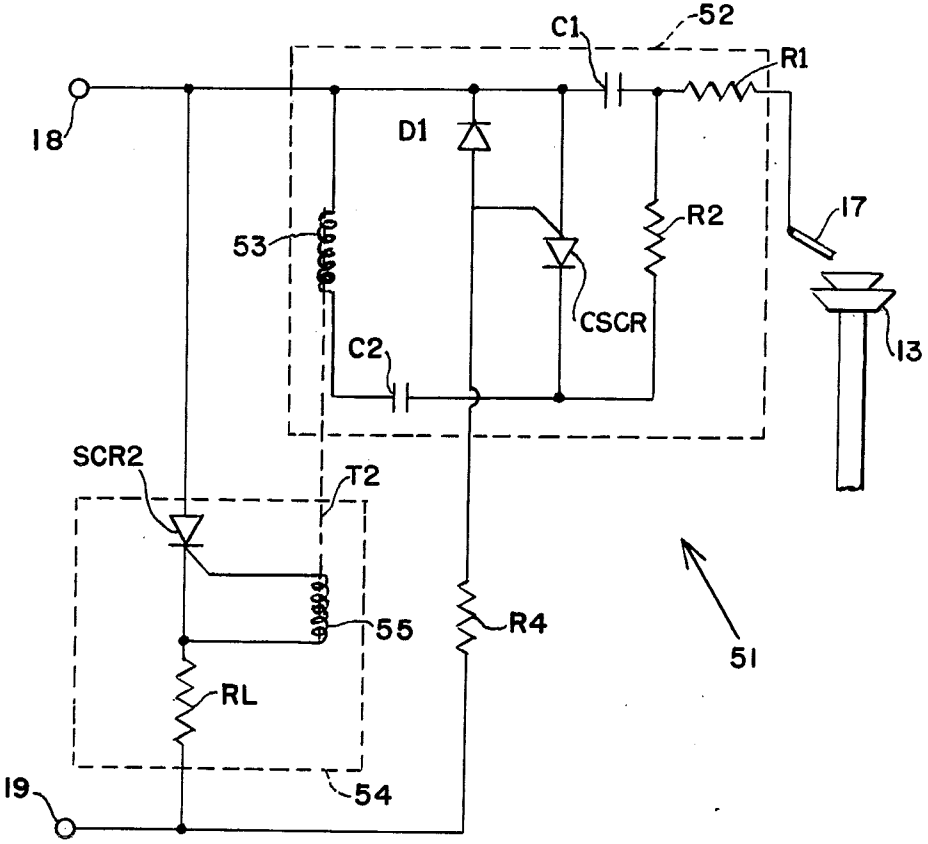
FIG. 3 is a schematic circuit diagram of another preferred embodiment of the invention.

Referring now to FIG. 3, there is illustrated another embodiment 51 in which components identical to those shown in FIG. 1 are given corresponding reference numerals. A sensing circuit 52 is identical to the sensing circuit 15 of FIG. 1 except that a primary winding 53 of a transformer T2 replaces the resistor R3. A control circuit 54 includes a silicon controlled rectifier SCR2 and a load resistor RL connected in series across input terminals 18 and 19. Also included in the control circuit 54 is a secondary winding 55 of the transformer T2 connected between the gate of the SCR2 and the junction between the resistor RL and the cathode of the SCR2.

The operation of the embodiment 51 is similar to that described above for embodiment 11. However, in this case the presence of flame in region 12 is indicated at each discharge of the discharge capacitor C2 by a pulse through the primary winding 53. The resultant pulse in the secondary winding 55 fires the SCR2 so as to provide energizing current for the load RL. It should be noted that SCR2 is poled opposite to that shown in embodiment 11 and may be powered directly from the line instead of from a previously charged capacitor. It will be obvious that the load RL could include, for example, a valve controlling relay or an ignition transformer as in embodiment 11. Also, the starter circuit 41 shown in FIG. 1 could be similarly employed in embodiment 51.

Obviously, many modifications and variations of the present invention are possible in light of the above teachings. It is therefore, to be understood that within the scope of the appended claims the invention can be practised otherwise than as specifically described.

What is claimed is:

1. Circuit apparatus for monitoring a given condition and comprising:

condition responsive means for providing a direct current indicative of said condition;

energy storage means for storing energy conveyed by said direct current;

a.c. power source means for applying an alternating current through said energy storage means;

sampling means for periodically sampling the energy level stored in said energy storage means only during sequential sampling periods substantially smaller than half cycle periods of said alternating current; and timing means coupled to said sampling means and adapted to produce said sampling periods at substantially zero-crossings of said alternating current.

2. Circuit apparatus according to claim 1 wherein said timing means produces said samplings only on particular zero-crossings during which said alternating current is proceeding to flow in the same sense as said direct current.

3. Circuit apparatus according to claim 2 wherein said energy storage means comprises a capacitance charged by said direct current.

4. Circuit apparatus according to claim 3 including control means coupled to said sampling means and responsive to the level of energy sampled thereby.

5. Circuit apparatus according to claim 4 wherein said control means comprises condition control means for controlling said condition indicated by said direct current.

6. Circuit apparatus according to claim 2 wherein said sampling means comprises an electronic switching element having a gate electrode connected to said a.c. power source means.

7. Circuit apparatus according to claim 6 wherein said sampling means comprises a discharge capacitance charged in response to flow of said direct current and discharged during said sampling periods.

8. Circuit apparatus according to claim 7 wherein said energy storage means comprises a storage capacitance charged by said direct current so as to store energy conveyed thereby and coupled to said discharge capacitor so as to provide charging current thereto.

9. Circuit apparatus according to claim 8 wherein said control means comprises an electronic switching element connected so as to be fired in response to the discharge from said discharge capacitor of a given minimum energy level.

10. Circuit apparatus according to claim 9 wherein said control means further comprises condition control means for controlling said condition indicated by said direct current in response to firing of said electronic switching element.

* * * * *